US008494198B2

(12) United States Patent
Aldaz et al.

(10) Patent No.: US 8,494,198 B2
(45) Date of Patent: Jul. 23, 2013

(54) METHOD FOR OPERATING A HEARING SYSTEM, HEARING SYSTEM AND AUDIO GATEWAY DEVICES

(75) Inventors: Gabriel Aldaz, Smørum (DK); Tobias Toft, Nysted (DK); Rune Bøttzauw, Klampenborg (DK)

(73) Assignee: Oticon A/S, Smorum (DJ)

( * ) Notice: Subject to any disclaimer, the term of this patent is extended or adjusted under 35 U.S.C. 154(b) by 42 days.

(21) Appl. No.: 13/313,447

(22) Filed: Dec. 7, 2011

(65) Prior Publication Data

US 2012/0148077 A1 Jun. 14, 2012

Related U.S. Application Data

(60) Provisional application No. 61/421,223, filed on Dec. 9, 2010.

(30) Foreign Application Priority Data

Dec. 9, 2010 (EP) ..... 10194276

(51) Int. Cl.
*H04R 25/00* (2006.01)

(52) U.S. Cl.
USPC ..... 381/315; 381/312; 381/331

(58) Field of Classification Search
USPC ..... 381/312, 314–316, 320, 322, 324, 381/330–331
See application file for complete search history.

(56) References Cited

U.S. PATENT DOCUMENTS

| | | | | |
|---|---|---|---|---|
| 3,659,056 | A * | 4/1972 | Morrison et al. | 381/315 |
| 5,343,532 | A * | 8/1994 | Shugart, III | 381/315 |
| 6,021,207 | A * | 2/2000 | Puthuff et al. | 381/315 |
| 2006/0039577 | A1 | 2/2006 | Sanguino et al. | |

FOREIGN PATENT DOCUMENTS

| | | | |
|---|---|---|---|
| WO | WO 2006/074655 | A1 | 7/2006 |
| WO | WO 2007/116103 | A2 | 10/2007 |
| WO | WO 2008/015293 | A2 | 2/2008 |
| WO | WO 2008/128563 | A1 | 10/2008 |

* cited by examiner

*Primary Examiner* — Suhan Ni
(74) *Attorney, Agent, or Firm* — Birch, Stewart, Kolasch & Birch, LLP

(57) ABSTRACT

A body-worn audio gateway device transmitting audio signals comprised in close-range electromagnetic signals may be used outside a car, where it may provide for hands-free mobile telephony and listening to music streamed directly to hearing devices worn by a user. When the user enters the car, he or she may want to use a corresponding in-car audio gateway device for the same purposes. This typically requires manual interaction e.g. to trigger the switch-over and to maintain hands-free operation of a carried mobile phone. Furthermore, the audio gateway devices may disturb each other, which may lead to malfunction, more troublesome interaction and/or reduced audio quality. To overcome this, the invention foresees means for detecting when the user enters and/or leaves the car and for automatically disabling functions of the first audio gateway device when the user is in the car.

20 Claims, 6 Drawing Sheets

METHOD FOR OPERATING A HEARING SYSTEM, HEARING SYSTEM AND AUDIO GATEWAY DEVICES

This nonprovisional application claims the benefit of U.S. Provisional Application No. 61/421,223 filed on Dec. 9, 2010 and to Patent Application No. 10194276.1 filed in the European Patent Office on Dec. 9, 2010, all of which are hereby expressly incorporated by reference into the present application.

TECHNICAL FIELD

The present invention relates to a method for operating a hearing system, to a hearing system and to audio gateway devices for use in such a system. More specifically, the present invention relates to hearing systems comprising one or more hearing devices communicating wirelessly with body-worn and/or car-mounted devices via audio gateway devices.

The invention may e.g. be useful in applications such as compensating for a hearing-impaired person's loss of hearing capability or augmenting a normal-hearing person's hearing capability.

BACKGROUND ART

Suffering from a hearing loss has an impact on just about every aspect of daily life. Be it conversing with the family and friends or shopping at the local supermarket, the reduced capability of perceiving sound can quickly present challenges unbeknown to persons with normal hearing. Driving a car is no exception. In many ways the in-car setting represents a form of condensed scenario for many of the general issues experienced by persons suffering from a hearing loss. Such issues include:

- Misalignment between required and available cognitive resources
  - Persons with a hearing loss often have problems multitasking if the tasks require auditory attention since they spend a disproportionate amount of mental effort to capture and decipher the sound.
  - The attention needed to conduct a conversation encroaches on the allocated attention needed to drive a car.
- Poor listening conditions
  - The sound environment has a huge impact on the perception of sound.
  - In a dynamic environment such as in the car it is not uncommon to experience elevated noise (traffic, children, radio) or poor acoustic conditions in general (hard surfaces, external noise, multiple sound sources, etc.).
- Poor conversation practice
  - Focus, visual contact (e.g. lip reading) and the use of gesticulation are critical elements of conducting a conversation when having a hearing loss.
  - In the car many of these can be difficult to achieve due to the seating positions (front vs. rear seats) and the need of the driver to keep his or her eyes on the road.

Hearing-impaired persons thus often experience problems when listening to radio, navigation devices and mobile phones as well as when communicating with other passengers in the car. These problems are in many ways similar to other every-day problems encountered when living with a hearing loss, but can potentially be more hazardous due to the safety-critical situation of operating a car. In the past, various measures have been proposed to remedy such problems.

Furthermore, a common need for many hearing-aid users is to be able to get a clear audio signal directed into the hearing aid from another electronic device, such as a mobile phone or a portable music player. To satisfy this need, hearing systems often comprise an audio gateway device, such as e.g. the Oticon Streamer (registered trade mark). An audio gateway device is a device that takes audio inputs from other devices with audio output, transcode the audio inputs and transmits one or more of them to the hearing aid. The audio input may come from different sources, e.g. a Bluetooth (registered trademark) data connection, an analog audio-input or a wireless microphone. Some Bluetooth-equipped audio gateway devices also act as a two-way communication device with mobile phones, enabling the hearing aid to work as a hands-free headset in conjunction with a microphone comprised in or connected to the audio gateway device. Audio gateway devices also often provide remote control functionality for the hearing aids.

The communication between the audio gateway device and the hearing aids may take place via a portable teleloop converter or a portable frequency modulation (FM) or amplitude modulation (AM) radio system. Alternatively, Near-Field Magnetic Induction (NFMI) may be used for streaming audio to the hearing aid in an almost lossless digital format. The NFMI technology makes it possible to transmit the high quality signal using very little power, but only within a limited range. For this reason, audio gateway devices using NFMI often comprise a neck-loop antenna to improve the signal strength and range. Without a neck-loop antenna, the range is typically about 30 cm or less. With a neck-loop antenna, the range may be increased to about 50 to 60 cm. In both cases, the relative orientation of the antenna and the receiving coil has a strong influence on the achievable range. Due to the characteristics of the antenna it is necessary to wear the loop around the neck to avoid dropouts in the signal.

Patent application WO 2008/015293 discloses a hearing system comprising one or two hearing devices, which are capable of receiving wireless audio signals from in-car devices, such as a car stereo, a CD player and/or a navigation system. The hearing system comprises a processing unit receiving the audio signals from the in-car devices and streaming one or more of the audio signals to the hearing devices. The signals may be transmitted via radio, e.g. according to the Bluetooth standard. The hearing system may comprise additional devices, such as a wireless remote control or a remote microphone, meant to be worn or carried by the hearing-device user. The output level of the hearing devices may be controlled from the remote control and/or from a user control, which may be e.g. mounted in the steering wheel. A control unit ensures that the output level and/or the amplification of microphone signals in the hearing devices is kept above a minimum value when the hearing devices receive data from the processing unit.

Patent application US 2006/0039577 discloses a hearing system comprising a hearing assistance device and a wireless communications adapter. The wireless communications adapter receives audio signals from remote devices via radio, e.g. according to the Bluetooth standard, and transmits the audio signals to the hearing assistance device via NFMI signals. A remote device may e.g. be a cellular phone. The wireless communications adapter may be embodied as a pendant to be worn in a neck loop, which simultaneously functions as an inductive antenna for the NFMI signals. The wireless communications adapter may comprise a microphone, a volume control and various buttons, the settings of which may be transmitted to the hearing assistance device. The wireless communications adapter may be battery-powered.

Teleloop, FM, AM and NFMI transmitters used in or with body-worn audio gateway devices, such as the wireless communications adapter mentioned above, are typically designed to have a limited communication range in order to save battery energy. Due to the smaller battery sizes typically used in hearing devices, saving energy is even more important in systems with bidirectional communication between the hearing devices and the audio gateway device. Limiting the communication range is possible because the communication between the audio gateway device and the hearing devices typically takes place over a short distance, e.g. between the neck and the ears of the hearing-device user or between a breast pocket and the ears. In the following, limited-range electromagnetic signals used for communication between the audio gateway device and the hearing devices over such short distances are generally referred to as "close-range electromagnetic signals". In communication between hearing devices and other devices, the use of close-range electromagnetic signals is generally preferred over technologies with larger ranges, such as e.g. Bluetooth radio, since the use of close-range electromagnetic signals enables much lower power consumption in the hearing devices.

A body-worn audio gateway device is typically used outside the car, where it may provide for e.g. hands-free mobile telephony and listening to music streamed directly to the hearing devices. It may also be used when driving, but with a number of disadvantages. Due to the restricted body position when driving, the user typically makes more extreme head movements than outside the car. Since the transmission range is limited, such head movements may lead to poor reception of the close-range electromagnetic signals and thus to distortion or pauses in the streamed audio signals. For audio gateway devices with a neck loop, the neck loop must be worn at all times, which may be tiring. The neck loop or the pendant may become entangled with the seat belt, and user controls on the audio gateway device can be difficult to reach and see. This increases the risk of accidentally activating functions and/or changes in the hearing systems, such as e.g. lowering or raising the gain, muting, switching inputs etc. Reacting to such accidental events may distract the driver. Furthermore, the battery powering of the audio gateway device often limits its duration of use.

When a user wearing a hearing system with a body-worn audio gateway device enters a car equipped with an in-car system, such as the one described further above, he or she may thus want to switch to the in-car system for streaming audio signals to the hearing devices. This typically requires manual interaction e.g. to trigger the switch-over and to maintain hands-free operation of a carried mobile phone. Similar considerations apply when leaving the car. Furthermore, if the audio gateway device is not shut off in the car, the audio gateway device and the in-car system may disturb each other, which may lead to malfunction of the systems, more troublesome interaction with the devices and systems and/or reduced audio quality.

There is therefore a need for a hearing system and a method for operating a hearing system, which reduce the above mentioned problems associated with switching over from the outside-car environment to the in-car environment and/or vice versa.

It is an object of the present invention to provide a method for operating a hearing system, which method reduces the above mentioned problems. It is a further object of the present invention to provide a hearing system, which reduces the above mentioned problems. A further object is to provide audio gateway devices that may be used in such methods and systems.

DISCLOSURE OF THE INVENTION

These and other objects of the invention are achieved by the invention defined in the accompanying independent claims. Further objects of the invention are achieved by the embodiments defined in the dependent claims and in the detailed description of the invention.

In the present context, a "hearing device" refers to a device, such as e.g. a hearing aid or an active ear-protection device, which is adapted to improve or augment the hearing capability of an individual by receiving acoustic signals from the individuals' surroundings, modifying the acoustic signals electronically and providing audible signals to at least one of the individual's ears. Such audible signals may e.g. be provided in the form of acoustic signals radiated into the individual's outer ears, acoustic signals transferred as mechanical vibrations to the individual's inner ears via the bone structure of the individual's head and/or electric signals transferred to the cochlear nerve of the individual. A "hearing system" refers to a system comprising one or two hearing devices. A "binaural hearing system" refers to a system comprising one or two hearing devices and being adapted to provide audible signals to both of the individual's ears. Both hearing systems and binaural hearing systems may comprise "auxiliary devices", which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems and binaural hearing systems may e.g. be used in compensating for a hearing-impaired person's loss of hearing capability or augmenting a normal-hearing person's hearing capability. A "car" refers to a motor-driven, wheeled road vehicle with a cabin, such as e.g. an automobile or a truck.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

In the following, details of preferred embodiments of the invention are explained with reference to the FIGs.

Figure 1:
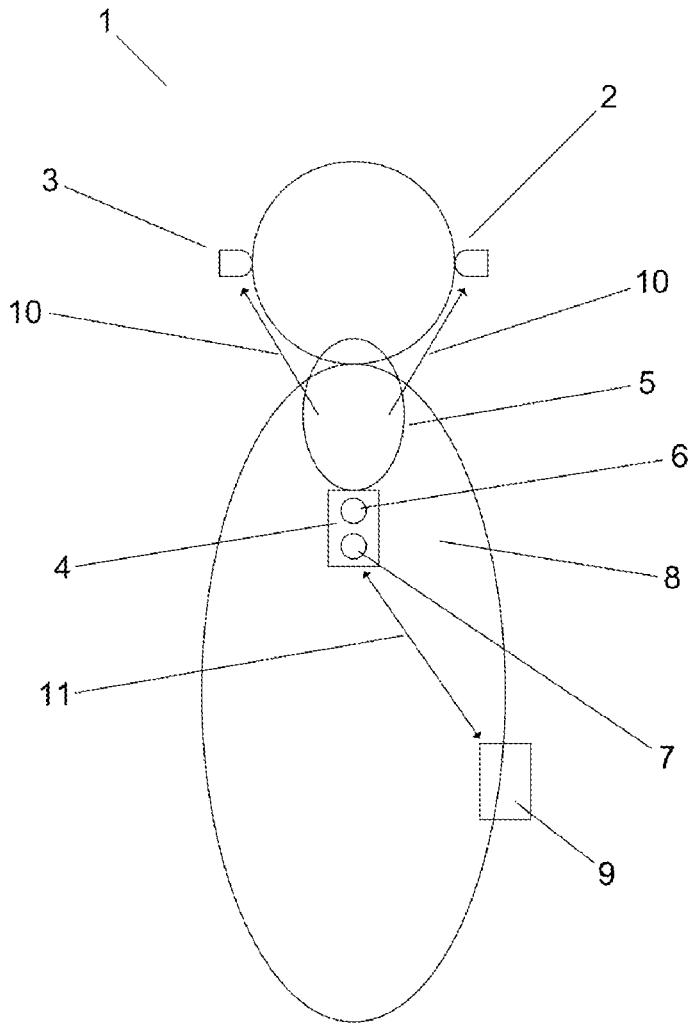
FIG. 1 shows an embodiment of a hearing system according to the invention when used outside a car.

The hearing system 1 shown in FIG. 1 comprises a left-ear hearing device 2, a right-ear hearing device 3 and a body-worn audio gateway device 4 with a neck-loop antenna 5, a microphone 6 and a user control 7. The hearing devices 2, 3 are arranged at respective ears of a user 8, who carries the neck-loop 5 around the neck. The body-worn audio gateway device 4 is attached as a pendant to the neck-loop 5 and is thus located at the front of the user's chest, where the microphone 6 may pick up the sound from the user's voice and the user control 7 is easily accessible to the user 8. The user 8 also carries a mobile phone 9, which is not part of the hearing system 1.

When the user 8 is outside the car, the hearing system 1 is in an outside-car mode in which the body-worn audio gateway device 4 functions similar to the prior art wireless communications adapter described further above. Audio signals, e.g. from the microphone 6 or the mobile phone 9, and control signals, e.g. from the user control 7, are digitised and transmitted to the hearing devices 2, 3 via a wireless head link 10 by means of NFMI signals radiated from the neck-loop antenna 5. During phone calls, audio signals from the mobile phone 9 are transmitted to the body-worn audio gateway device 4 via a wireless body link 11 by means of digitally coded, packet-based radio signals according to the Bluetooth standard. Audio signals from the microphone 6 and control signals from the user control 7 are transmitted to the mobile phone 9 via the body link 11. The user 8 may thus use the body-worn audio gateway device 4 for hands-free telephony. Incoming calls are answered and terminated by manipulating the user control 7. Voice signals from the remote party are relayed to the hearing devices 2, 3 via the body-worn audio gateway device 4, which further picks up voice sound from the user 8 by means of the microphone 6 and transmits corresponding voice signals to the mobile phone 9 via the body link 11.

The head link 10 may alternatively be implemented using another type of close-range electromagnetic signals, such as e.g. teleloop signals, or low-power FM or AM radio signals. When using FM or AM radio signals, the neck-loop antenna 5 is preferably replaced with a radio frequency antenna (not shown). The hearing devices 2, 3 may comprise corresponding transmitters (not shown) and the body-worn audio gateway device 4 may comprise a corresponding receiver (not shown), allowing the head link 10 to be bidirectional. In this case, the voice sound from the user 8 may be picked up by microphones in the hearing devices 2, 3, digitised and transmitted to the body-worn audio gateway device 4 via the head link 10 during hands-free telephony.

Figure 2:
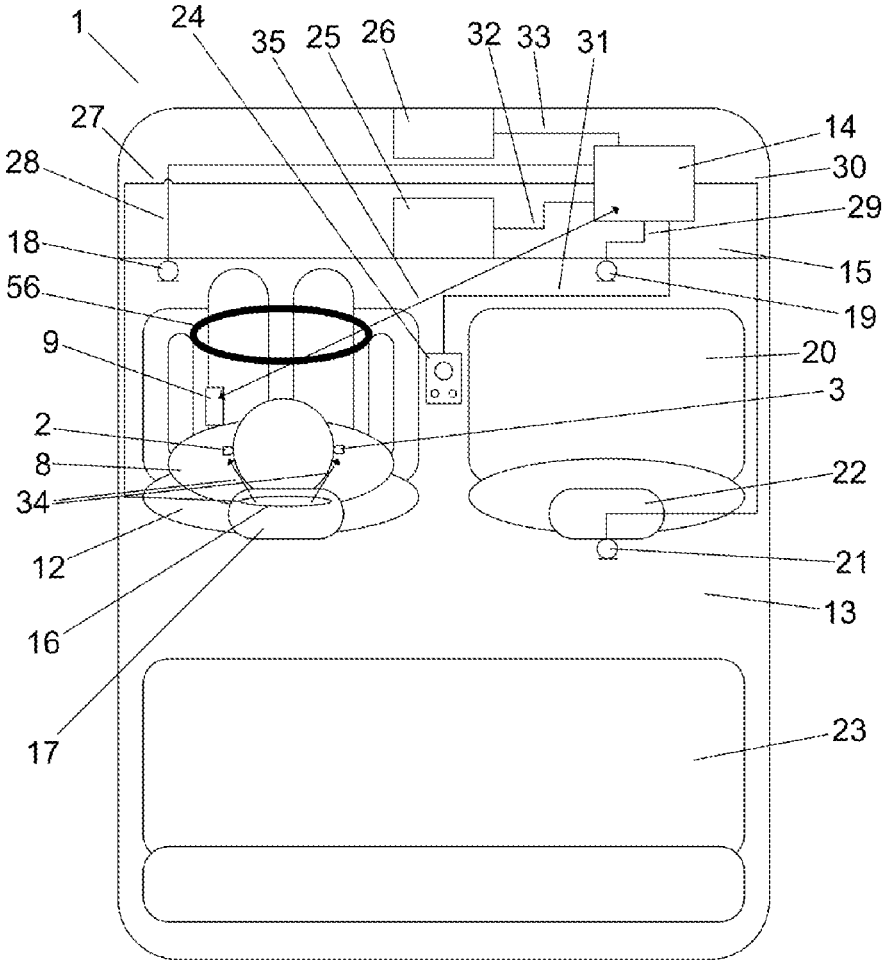
FIG. 2 shows the hearing system of FIG. 1 when used in the car.

In FIG. 2, the hearing system 1 of FIG. 1 is shown with the user 8 seated in the driver seat 12 in a car cabin 13 in which further devices comprised in the hearing system 1 are permanently mounted. These devices comprise an in-car audio gateway device 14, which is mounted beneath the car's dashboard 15, a headrest antenna 16 mounted in the headrest 17 of the driver seat 12, a directional driver-seat microphone 18 mounted in the dashboard 15 and arranged to pick up voice sound from the user 8 when seated in the driver seat 12, a directional passenger-seat microphone 19 mounted in the dashboard 15 and arranged to pick up voice sound from a passenger (not shown) in the passenger seat 20, a rear-seat microphone 21 mounted in the headrest 22 of the passenger seat 20 and arranged to pick up voice sound from passengers (not shown) in the rear seat 23, and a user interface unit 24 mounted between the driver seat 12 and the passenger seat 20. The user 8 is wearing the hearing devices 2, 3, the body-worn audio gateway device 4, the neck-loop antenna 5 and the mobile phone 9 as shown in FIG. 1 and explained further above. Mounted in the car are further a car stereo 25 with various controls and a navigation device 26, e.g. a Global Positioning System (GPS) device, with a touch-screen. The headrest antenna 16, the driver-, passenger- and rear-seat microphones 18, 19, 21, the user interface unit 24, the car stereo 25 and the navigation device 26 are connected with the in-car audio gateway device 14 via respective wired links 27, 28, 29, 30, 31, 32, 33.

When the user 8 is seated in the driver seat 12, the hearing system 1 is in an in-car mode in which the in-car audio gateway device 14 performs functions similar to the functions performed by the prior art processing unit described further above. Audio signals, e.g. from the driver-, passenger- and/or rear-seat microphones 18, 19, 21, the car stereo 25 and/or the navigation device 26 are transmitted to the in-car audio gateway device 14 via the respective wired links 28, 29, 30, 32, 33. Control signals from the user interface unit 24 are transmitted to the in-car audio gateway device 14 via the wired link 31. The in-car audio gateway device 14 transmits the received audio and control signals to the hearing devices 2, 3 via a wireless headrest link 34 by means of NFMI signals radiated from the headrest antenna 16. During phone calls, audio signals from the mobile phone 9 are transmitted to the in-car audio gateway device 14 via a wireless cabin link 35 by means of digitally coded, packet-based radio signals according to the Bluetooth standard. Audio signals from the driver-seat microphone 18 and control signals from the user interface unit 24 are transmitted to the mobile phone 9 via the cabin link 35. The user 8 may thus use the in-car audio gateway device 14 for hands-free telephony. Incoming calls are answered and terminated by manipulating controls on the user interface unit 24. Voice signals from the remote party are relayed to the hearing devices 2, 3 via the in-car audio gateway device 14, which further picks up voice sound from the user 8 by means of the driver-seat microphone 18 and transmits corresponding voice signals to the mobile phone 9 via the cabin link 35.

Similar to the head link 10, the headrest link 34 may alternatively be implemented using another type of close-range electromagnetic signals, such as e.g. low-power FM or AM radio signals, in which case the headrest antenna 16 is preferably replaced with a suitable radio frequency antenna (not shown). The hearing devices 2, 3 may comprise corresponding transmitters (not shown) and the in-car audio gateway device 14 may comprise a corresponding receiver (not shown), allowing the headrest link 34 to be bidirectional. In this case, the voice sound from the user 8 may be picked up by microphones in the hearing devices 2, 3, digitised and transmitted to the in-car audio gateway device 14 via the headrest link 34 during hands-free telephony. Preferably, the headrest link 34 is implemented using the same technology as the head link 10 in order to reduce the complexity and the power consumption of the hearing system 1.

The headrest antenna 16 may alternatively be placed in other locations in the cabin 13 close to the user's head, e.g. under or in the cabin roof, on or in the top portion of the driver seat 12 or on the vertical strut between the windows on the driver side of the cabin 13. If the headrest link 34 is implemented with teleloop signals, the antenna may be placed on the cabin floor around the driver seat 12 and/or one or more of the other seats 20, 23. Furthermore, the hearing system 1 may comprise one or more further headrest antennas (not shown) mounted in the passenger seat 20 and/or the rear seat 23, thus allowing the user 8 to benefit from the hearing system 1 when seated in the car as a passenger.

When the hearing system 1 is in the in-car mode, one or more functions and/or units 5, 6, 7, 45 (see FIG. 4) of the body-worn audio gateway device 4 are disabled in order to avoid that the two audio gateway devices 4, 14 disturb each other. The transmission of close-range electromagnetic signals by the body-worn audio gateway device 4 may be disabled to avoid collisions with corresponding signals transmitted by the in-car audio gateway device 14. Additionally, reception of close-range electromagnetic signals by the body-worn audio gateway device 4 may be disabled to reduce its power consumption. In other words, the head link 10 may be partly or completely disabled. Similarly, the body link 11 may be partly or completely disabled to reduce the power consumption and/or to avoid signal collisions. The microphone 6 in the body-worn audio gateway device 4 may be disabled to reduce the power consumption of the latter. The user control 7 of the body-worn audio gateway device 4 may be disabled to reduce the power consumption of the latter and/or to avoid accidental activation of functions and/or changes in the hearing system 1. Selecting which functions and/or units 5, 6, 7, 45 to disable may be made when designing the hearing system 1 and/or dynamically during use of the hearing system 1. In the latter case, the decision may be made in dependence on detected system states and/or external events.

In order to achieve a smooth switch-over from the outside-car mode to the in-car mode and vice versa, the hearing system 1 detects when the body-worn audio gateway device 4 is in a predefined location with respect to the car and automatically and selectively enables the in-car mode when the body-worn audio gateway device 4 is detected to enter or to be present in the predefined location. Since the in-car audio gateway device 14 is mounted in a fixed location in the car, detecting when the body-worn audio gateway device 4 is in a predefined location with respect to the car is made by detecting when the body-worn audio gateway device 4 is in a predefined location with respect to the in-car audio gateway device 14. The relative location of the body-worn audio gateway device 4 is thus used to detect whether the user 8 is seated in the driver seat 12 and/or one of the other seats 20, 23 or not. Correspondingly, the hearing system 1 automatically and selectively enables the outside-car mode when the body-worn audio gateway device 4 is detected to leave or to not be present in the predefined location. In the present context, "automatically" implies that no direct interaction is required from the user 8 other than—of course—the respective actions of entering and leaving the cabin 13 and/or a seat 12, 20, 23. When enabling the in-car mode, the hearing system 1 automatically disables the selected one or more functions and/or units 5, 6, 7, 45 of the body-worn audio gateway device 4. Correspondingly, when enabling the outside-car mode, the hearing system 1 automatically re-enables previously disabled functions and/or units 5, 6, 7, 45 of the body-worn audio gateway device 4.

When enabling the in-car mode, the hearing system 1 automatically transfers information about the connected mobile phone 9 from the body-worn audio gateway device 4 to the in-car audio gateway device 14. The information transfer may take place via the cabin link 35, which requires that the body-worn audio gateway device 4 connects to the Bluetooth network of the in-car audio gateway device 14. The information transfer is preferably made before disabling the body link 11. The information transfer enables the in-car audio gateway device 14 to automatically take over the hands-free telephony function from the body-worn audio gateway device 4. Similar interactions take place to redirect the hands-free telephony function to the body-worn audio gateway device 4 when the hearing system 1 enables the outside-car mode.

Instead of disabling the transmission of close-range electromagnetic signals by the body-worn audio gateway device 4 in the in-car mode, transmission of close-range electromagnetic signals by the in-car audio gateway device 14 and by the body-worn audio gateway device 4 may be coordinated using a time-division scheme for access to the head link 10/headrest link 34. However, using a time-division scheme requires that the body-worn audio gateway device 4 keeps a transmitter for the close-range electromagnetic signals and possibly a receiver open, at least for some of the time in the car, which results in a larger power consumption in the body-worn audio gateway device 4 and thus in a reduced battery life.

Figure 3:
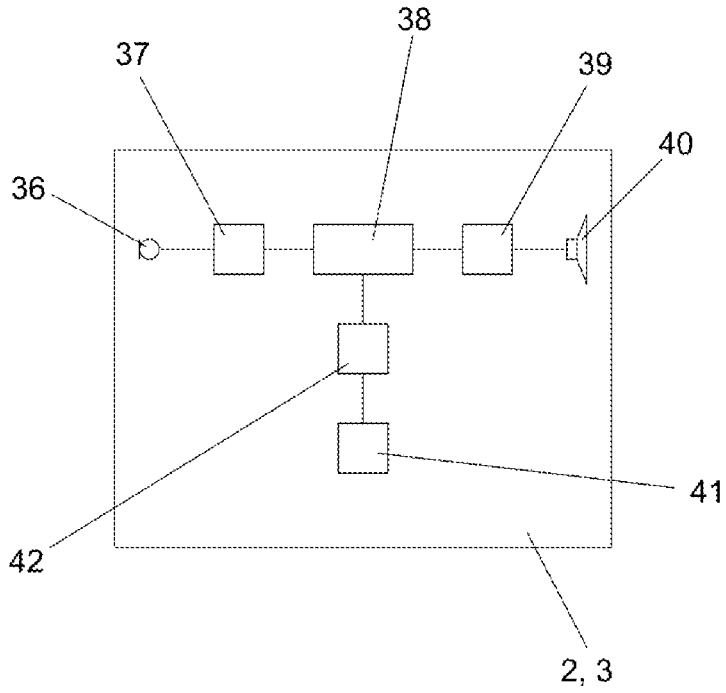
FIG. 3 shows a hearing device comprised in the hearing system of FIG. 1.

FIG. 3 shows details of the hearing devices 2, 3. Each hearing device 2, 3 comprises a microphone 36, an analog/digital-converter 37, a digital signal processor 38, a digital/analog-converter 39 and a speaker 40 connected in the mentioned order to form a primary audio signal path. The microphone 36 is adapted to receive acoustic signals from the user's surroundings and to provide a corresponding electric input signal to the analog/digital-converter 37. The analog/digital-converter 37 is adapted to convert the electric input signal into a digital input signal and to provide it to the digital signal processor 38. The digital signal processor 38 is adapted to process the digital input signal and to provide a corresponding digital output signal to the digital/analog-converter 39. The digital/analog-converter 39 is adapted to convert the digital output signal into an electric output signal and to provide it to the speaker 40, which is adapted to radiate a corresponding acoustic output signal into an ear of the user 8. The processing within the digital signal processor 38 may comprise e.g. amplification, frequency filtering, level attenuation, level compression, level expansion, voice detection, suppression of acoustic feedback and/or other processing steps generally known in relation to hearing devices such as e.g. hearing aids and/or active ear-protection devices.

Each hearing device 2, 3 further comprises a receiver coil 41 and a decoder 42. The receiver coil is adapted to receive NFMI signals and provide a corresponding electric communication signal to the decoder 42. The decoder 42 is adapted to extract digital communication signals from the electric communication signal and to provide the digital communication signals to the digital signal processor 38. The digital signal processor 38 is adapted to process the digital communication signal, to respond to commands comprised in the digital communication signal and to include sound signals comprised in the digital communication signal in the digital output signal provided to the digital/analog-converter 39. As mentioned further above, the receiver coil 41 and the decoder 42 may be replaced with a telecoil (not shown) and a further analog/digital-converter (not shown) in order to allow reception of teleloop signals. Alternatively, the receiver coil 41 and the decoder 42 may be replaced with a radio frequency antenna (not shown), a radio receiver (not shown) and/or a radio transmitter (not shown) for receiving and/or transmitting low-power FM or AM radio signals. In this case, the digital signal processor 38 may be adapted to provide the digital input signal originating from the microphone 36 to the radio transmitter.

Figure 4:
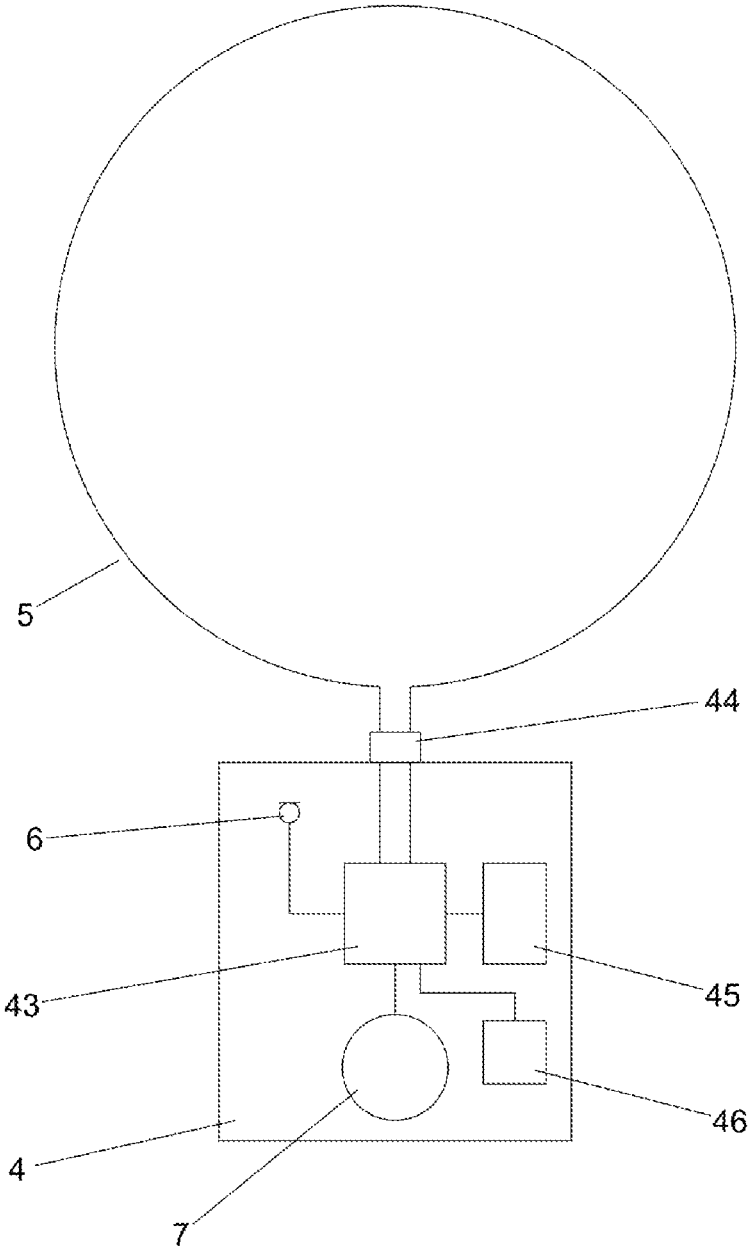
FIG. 4 shows a body-worn audio gateway device comprised in the hearing system of FIG. 1.

FIG. 4 shows details of the body-worn audio gateway device 4. A gateway controller 43 in the pendant part of the body-worn audio gateway device 4 is connected with the neck-loop antenna 5 via a detachable connector 44. The gateway controller 43 is further connected to the microphone 6, the user control 7, a Bluetooth radio transceiver 45, which transmits and receives signals via the body link 11, and a detector coil 46. The gateway controller 43 receives input signals from the microphone 6, the user control 7 and/or the Bluetooth radio transceiver 45 and encodes corresponding digital signals in the electric signals provided to the neck-loop antenna 5. The selection of which signal(s) to pass on and their levels is made by the user 8 via the user control 7. Similarly, the gateway controller 43 receives input signals from the microphone 6 and/or the user control 7 and encodes corresponding digital signals in the electric signals provided to the Bluetooth radio transceiver 45. The detector coil 46 is adapted to detect NFMI signals transmitted by the in-car audio gateway device 14 via the headrest antenna 16 and to provide a corresponding indication signal to the gateway controller 43. When the gateway controller 43 receives an indication signal from the detector coil 46 indicating that the detector coil 46 is within the transmission range of the headrest antenna 16, the gateway controller 43 executes an information transfer with the in-car audio gateway device 14 via the Bluetooth radio transceiver 45 as described further above and subsequently disables one or more functions and/or units 5, 6, 7, 45 of the body-worn audio gateway device 4 as also described further above. In the case that the head link 10 is implemented using another type of close-range electromagnetic signals, such as e.g. teleloop signals, or low-power FM or AM radio signals, the detector coil 46 is instead adapted to detect such signals transmitted by the in-car audio gateway device 14 via a corresponding antenna (not shown).

Figure 5:
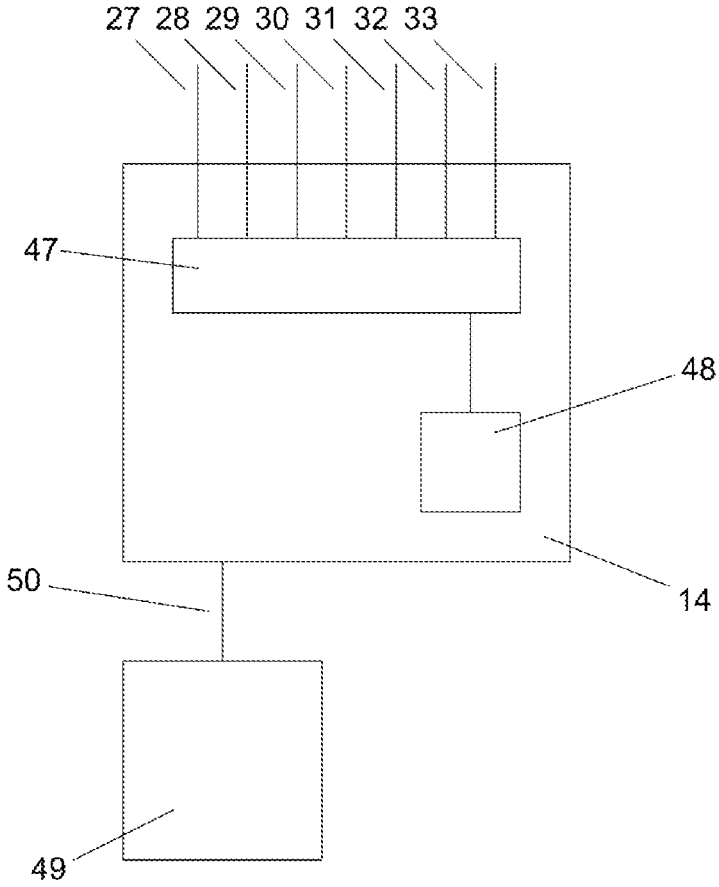
FIG. 5 shows an in-car audio gateway device comprised in the hearing system of FIG. 1.

FIG. 5 shows details of the in-car audio gateway device 14. A gateway controller 47 in the in-car audio gateway device 14 is connected with the headrest antenna 16, the microphones 18, 19, 21, the user interface unit 24, the car stereo 25 and the navigation device 26 via the wired links 27, 28, 29, 30, 31, 32, 33. The gateway controller 47 is further connected with a Bluetooth radio transceiver 48, which transmits and receives signals via the cabin link 35. The gateway controller 47 receives input signals from the microphones 18, 19, 21, the user interface unit 24, the car stereo 25, the navigation device 26 and/or the Bluetooth radio transceiver 48 and encodes corresponding digital signals in the electric signals provided to the headrest antenna 16. The selection of which signal(s) to pass on and their levels is made by the user 8 via corresponding controls 51, 52, 53, 54 (see FIG. 6) on the user interface unit 24. Similarly, the gateway controller 47 receives input signals from the driver-seat microphone 18 and/or the user interface unit 24 and encodes corresponding digital signals in the electric signals provided to the Bluetooth radio transceiver 48.

As an alternative to the body-worn audio gateway device 4 having a detector coil 46, the hearing system 1 may comprise a similar detector coil (not shown) placed e.g. in the headrest 17, connected to the gateway controller 47 in the in-car audio gateway device 14 and adapted to detect NFMI signals or another type of close-range electromagnetic signals transmitted by the body-worn audio gateway device 4. When the gateway controller 47 receives an indication signal from the detector coil indicating that the detector coil is within the transmission range of the body-worn audio gateway device 4, the gateway controller 47 executes an information transfer with the body-worn audio gateway device 4 via the Bluetooth radio transceiver 48 as described further above. The body-worn audio gateway device 4 subsequently disables one or more functions and/or units 5, 6, 7, 45 as also described further above. As a further alternative, the presence of the body-worn audio gateway device 4 in the cabin 13 may be detected via the cabin link 35. For instance, the gateway controller 43 of the body-worn audio gateway device 4 may detect via its Bluetooth radio transceiver 46 that the Bluetooth radio transceiver 48 of the in-car audio gateway device 14 appears in the Bluetooth network, and/or the gateway controller 47 of the in-car audio gateway device 14 may detect via its Bluetooth radio transceiver 48 that the Bluetooth radio transceiver 46 of the body-worn audio gateway device 4 appears in the Bluetooth network.

Alternatively to, or in addition to, the automatic detection described above, the presence of the body-worn audio gateway device 4 in the cabin 13 may be detected by means of a docking station 49 in which the user 8 places the body-worn audio gateway device 4 when seated in the car. The docking station 49 is preferably connected to the in-car audio gateway device 14 by means of a wired connection 50. The docking station 49 detects the insertion of the body-worn audio gateway device 4 by means of electric contacts or other well known alternatives and transmits a corresponding indication signal to the in-car audio gateway device 14. The docking station 49 or the in-car audio gateway device 14 may further supply a charge current to the body-worn audio gateway device 4. Despite that the use of the docking station 49 requires a manual interaction by the user 8, it may still be a preferred solution, because it provides for a simple possibility to charge the batteries in the body-worn audio gateway device 4 during driving and further reduces the risk of the body-worn audio gateway device 4 becoming entangled with the seat belt. Furthermore, the information exchange mentioned further above may take place via the wired connection 50.

Some or all of the connections 27, 28, 29, 30, 31, 32, 33 may be implemented using built-in connections of the car (i.e. connections built in when manufacturing the car), e.g. the widely known and adopted CAN-bus. Alternatively, some or all of the connections 27, 28, 29, 30, 31, 32, 33 may be wireless, e.g. using the cabin link 35 or other wireless means, such as a high-speed IrDA (registered trademark) optical link or a Zigbee (registered trademark) radio frequency network.

The in-car audio gateway device 14 may perform "intelligent" audio source management such as automatic prioritisation of sources and noise cancelling. Via the CAN-bus, the in-car audio gateway device 14 may further receive various status and/or warning information from the control system of the car, e.g. "low gas", "service check needed" or "speed limit exceeded", and provide corresponding audible sound signals in the close-range electromagnetic signals transmitted to the hearing devices 2, 3.

Figure 6:
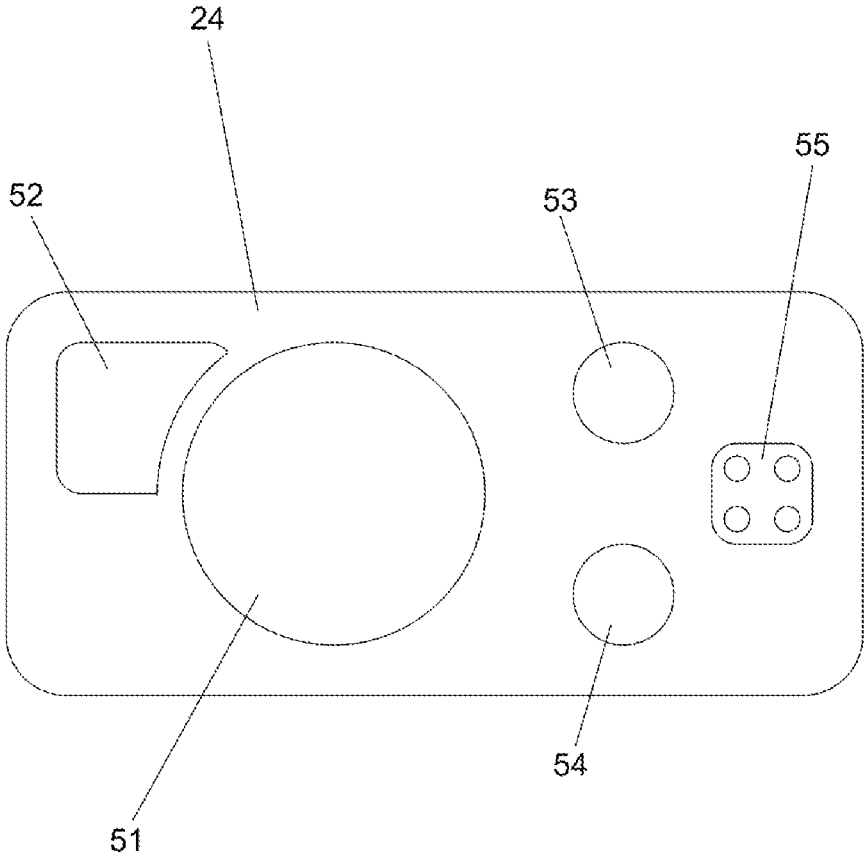
FIG. 6 shows a user interface unit comprised in the hearing system of FIG. 1.

FIG. 6 shows details of the user interface unit 24. It comprises a multi-function control 51, a source-selection control 52, two microphone controls 53, 54 and four status indicators 55. The user interface unit 24 is preferably mounted between the front seats 12, 20 or in the middle section of the dashboard 15. All controls 51, 52, 53, 54 preferably provide tactile and/or visual feedback of the current action and/or setting.

Short pressing of the multi-function control 51 causes answering or hanging up a mobile phone call. The hearing system 1 automatically mutes all other audio sources 18, 19, 21, 25, 26 during a phone call. Long pressing (more than 3 s) allows making a call via the voice dial system of the mobile phone 9. Double-pressing causes calling of the last called number. When an incoming call is announced, turning the control 51 all the way against the clock ignores the call. When no incoming call is pending, short pressing mutes or unmutes all device sources 25, 26, i.e. audio sources other than microphones 18, 19, 21, to the in-car audio gateway device 14, thus allowing the user 8 to communicate with passengers in the car via the microphones 19, 21 without being disturbed by e.g. the car stereo 25 or the navigation unit 26. Turning the control 51 changes the level of the signals provided to the hearing devices 2, 3 by the in-car audio gateway device 14. Additional functions may be implemented, such as e.g. browsing the address book on the mobile phone 9, which however requires that the hearing system 1 also comprises a display screen.

Short pressing of the source-selection control 52 selects which of the device sources 25, 26 is routed to the hearing devices 2, 3. Long pressing causes muting of all audio sources 18, 19, 21, 25, 26. Pressing the microphone controls 53, 54 switches respectively the front- and the rear-seat microphone 19, 21 on and off. Turning the controls 53, 54 changes the microphone gains.

The four status indicators 55 are LED indicators showing the current status of the presence detection of the body-worn audio gateway device 4, the status of the front- and rear-seat microphones 19, 21 as well as of the status of the connection to the mobile phone 9. Each LED indicator 55 may use different colours and/or different time patterns to indicate the different statuses. An annular light guide (not shown) may be arranged around the base of the multi-function control 51. The annular light guide may replace one of the above mentioned status indicators or serve as a further status indicator.

A lock switch (not shown) may be added to allow locking of the other controls 51, 52, 53, 54 in order to avoid accidental activation, e.g. by children in the car. In the case that the user interface unit 24 is connected wirelessly to the in-car audio gateway device 14, the user interface unit 24 is preferably battery powered.

The functioning of the user interface unit 24 is intended to allow a "natural" way of using the hearing system 1. For instance, the car stereo 25 and the navigation unit 26 continue to provide audible sound via their respective speakers, and their sound level is controlled by respective volume controls of the devices 25, 26. The multi-function control 51 thus only affects the level of the signals provided to the hearing devices 2, 3 by the in-car audio gateway device 14.

The hearing system 1 may comprise further user interface units (not shown), possibly with reduced controls and/or functions. The further user interface units may comprise one or more controls, which perform functions similar to those of the user interface unit 24. Such controls may also be implemented as virtual controls on a touch screen. The further user interface units may e.g. be placed in the rear portion of the cabin 13 and allowing passengers in the rear seat 23 to control the hearing system 1. Alternatively or additionally, built-in controls in the steering wheel 56, the car stereo 25 and/or the navigation unit 26 may be utilised for controlling the hearing system 1. Also the body-worn audio gateway device 4—when placed in the docking station 49—may serve as a further user interface unit or even replace the user interface unit 24. In the latter case, settings of the controls 7 of the body-worn audio gateway device 4 are transmitted to the in-car audio gateway device 14 via the docking station 49 and the wired connection 50.

Although shown and described as distinct components, the functional blocks of the hearing devices 2, 3, the body-worn audio gateway device 4 and/or the in-car audio gateway device 14 may be implemented in any suitable combination of hardware, firmware and software and/or in any suitable combination of hardware units. Furthermore, any single hardware unit may execute the operations of several functional blocks in parallel or in interleaved sequence and/or in any suitable combination thereof.

Technical features mentioned herein in connection with hearing aids may be applied to other types of hearing devices with similar results and advantages, e.g. to solve similar problems.

Further modifications obvious to the skilled person may be made to the disclosed method, system and/or device without deviating from the spirit and scope of the invention. Within this description, any such modifications are mentioned in a non-limiting way.

Features and Advantages of Preferred Embodiments

The below described features of preferred embodiments of the invention may be combined arbitrarily with each other and/or with features mentioned above in order to adapt the system, the devices and/or the method according to the invention to specific requirements.

A preferred embodiment of the invention regards a method for operating a hearing system 1 comprising a hearing device 2, 3, a first audio gateway device 4 adapted to being worn by an individual 8 and a second audio gateway device 14 adapted to being mounted in a car.

The method comprises:

- in the hearing device 2, 3, extracting audio signals from close-range electromagnetic signals 10, 34 and providing audible signals to the individual 8 based on the extracted sound signals;
- in the first audio gateway device 4, extracting a first audio signal from an electromagnetic signal 11 received from a first remote device 9 and transmitting a close-range electromagnetic signal 10 comprising the first audio signal to the hearing device 2, 3 via a first antenna 5;
- in the second audio gateway 14, extracting a second audio signal from an electromagnetic or electric signal 28, 29, 30, 32, 33 received from a second remote device 18, 19, 21, 25, 26 and transmitting a close-range electromagnetic signal 34 comprising the second audio signal to the hearing device 2, 3 via a second antenna 16;
- detecting when the first audio gateway device 4 is in a predefined location with respect to the second audio gateway device 14; selectively enabling an in-car mode in dependence on the first audio gateway device 4 being in the predefined location; and disabling a function and/or a unit 5, 6, 7, 45 of the first audio gateway device 4 in the in-car mode.

The method allows for a smoother, safer, easier and power-saving operation of the hearing system 1.

The close-range electromagnetic signals 10, 34 may be near-field magnetic induction signals. Such signals allow reliable communication over short distances.

The close-range electromagnetic signals 10, 34 may be low-power radio signals. Such signals also allow reliable communication over short distances.

Disabling a function and/or a unit 5, 6, 7, 45 of the first audio gateway device 4 may comprise disabling transmission of close-range electromagnetic signals 10 by the first audio gateway device 4. This allows for reducing the power consumption in the first audio gateway device 4 and thus for an increased battery life.

Disabling a function and/or a unit 5, 6, 7, 45 of the first audio gateway device 4 may comprise disabling one or more user controls 7 on the first audio gateway device 4. This allows for reducing the power consumption in the first audio gateway device 4 and further reduces the risk of accidentally activating the user controls 7.

The method may further comprise: in the second audio gateway device 14, in the in-car mode, extracting a third audio signal from an electromagnetic signal 35 received from the first remote device 9 and transmitting a close-range electromagnetic signal 34 comprising the third audio signal to the hearing device 2, 3. This allows for using the second audio gateway device 14 for hands-free telephony via the mobile phone 9 already carried by the user 8.

The method may further comprise: automatically enabling the in-car mode when the first audio gateway device 4 enters the predefined location and/or automatically disabling the in-car mode when the first audio gateway device 4 leaves the predefined location. This allows for a smooth switch-over between the outside-car and the in-car situations, so that the user 8 will not have to perform any direct interaction with the hearing system 1 when entering and/or leaving the car. Specifically, this allows for reducing the risk of the user 8 forgetting to switch the link 11, 35 to the mobile phone 9 between the audio gateway devices 4, 14.

In a preferred embodiment of the invention, a hearing system 1 comprises a hearing device 2, 3 and a first audio gateway device 4 adapted to being worn by an individual 8.

The hearing device 2, 3 is adapted to extract audio signals from close-range electromagnetic signals 10, 34 and to provide audible signals to the individual 8 based on the extracted sound signals.

The first audio gateway device 4 is adapted to extract a first audio signal from an electromagnetic signal 11 received from a first remote device 9 and to transmit a close-range electromagnetic signal 10 comprising the first audio signal to the hearing device 2, 3 via a first antenna 5.

The hearing system 1 further comprises a second audio gateway device 14 adapted to being mounted in a car and means 46 for detecting when the first audio gateway device 4 is in a predefined location with respect to the second audio gateway device 14.

The second audio gateway device 14 is adapted to extract a second audio signal from an electromagnetic or electric signal 28, 29, 30, 32, 33 received from a second remote device 18, 19, 21, 25, 26 and to transmit a close-range electromagnetic signal 34 comprising the second audio signal to the hearing device 2, 3 via a second antenna 16.

The hearing system 1 is adapted to selectively enable an in-car mode in dependence on the first audio gateway device 4 being in the predefined location and to disable a function and/or a unit 5, 6, 7, 45 of the first audio gateway device 4 in the in-car mode.

The hearing system 1 may be operated in a smooth, safe, easy and power-saving way.

The close-range electromagnetic signals 10, 34 may be near-field magnetic induction signals. Such signals allow reliable communication over short distances.

The close-range electromagnetic signals 10, 34 may be low-power radio signals. Such signals also allow reliable communication over short distances.

The hearing system 1 may be further adapted to disable transmission of close-range electromagnetic signals 10 by the first audio gateway device 4 in the in-car mode. This allows for reducing the power consumption in the first audio gateway device 4 and thus for an increased battery life.

The hearing system 1 may be further adapted to disable one or more user controls 7 on the first audio gateway device 4 in the in-car mode. This allows for reducing the power consumption in the first audio gateway device 4 and further reduces the risk of accidentally activating the user controls 7.

The second audio gateway device 14 may be further adapted to extract a third audio signal from an electromagnetic signal 35 received from the first remote device 9 and to transmit a close-range electromagnetic signal 34 comprising the third audio signal to the hearing device 2, 3 when the hearing system 1 is in the in-car mode. This allows for using the second audio gateway device 14 for hands-free telephony via the mobile phone 9 already carried by the user 8.

The hearing system 1 may be further adapted to automatically enable the in-car mode when the first audio gateway device 4 enters the predefined location and/or to automatically disable the in-car mode when the first audio gateway device 4 leaves the predefined location. This allows for a smooth switch-over between the outside-car and the in-car situations, so that the user 8 will not have to perform any direct interaction with the hearing system 1 when entering and/or leaving the car. Specifically, this allows for reducing the risk of the user 8 forgetting to switch the link 11, 35 to the mobile phone 9 between the audio gateway devices 4, 14.

In a preferred embodiment of the invention, a first audio gateway device 4 is adapted to being worn by an individual 8. The first audio gateway device 4 is further adapted to extract an audio signal from an electromagnetic signal 11 received from a remote device 9 and to transmit a close-range electromagnetic signal 10 comprising the audio signal to a hearing device 2, 3 via an antenna 5. The first audio gateway device 4 comprises means 46 for detecting when the first audio gateway device 4 is in a predefined location with respect to a second audio gateway device 14 mounted in a car. The first audio gateway device 4 is further adapted to selectively enable an in-car mode in dependence on the first audio gateway device 4 being in the predefined location and to disable a function and/or a unit 5, 6, 7, 45 of the first audio gateway 4 device in the in-car mode. The first audio gateway device 4 may be used in a method and/or in a hearing system 1 according to the invention.

In a preferred embodiment of the invention, a first audio gateway device 14 is adapted to being mounted in a car. The first audio gateway device 14 is further adapted to extract an audio signal from an electromagnetic or electric signal 28, 29, 30, 32, 33 received from a remote device 18, 19, 21, 25, 26 and to transmit a close-range electromagnetic signal 34 comprising the audio signal to a hearing device 2, 3 via an antenna 16. The first audio gateway device 14 comprises means for detecting when a second audio gateway device 4 is in a predefined location with respect to the second audio gateway device 14. The first audio gateway device 14 is further adapted to selectively enable an in-car mode in dependence on the second audio gateway device 4 being in the predefined location and to transmit control signals comprising an indication of mode changes to the second audio gateway device 4. The first audio gateway device 14 may be used in a method and/or in a hearing system 1 according to the invention.

Some preferred embodiments have been described in the foregoing, but it should be stressed that the invention is not limited to these, but may be embodied in other ways within the subject-matter defined in the following claims. For example, the features of the described embodiments may be combined arbitrarily.

It is further intended that the structural features of the system and/or devices described above, in the detailed description of 'modes for carrying out the invention' and in the claims can be combined with the methods, when appropriately substituted by a corresponding process. Embodiments of the methods have the same advantages as the corresponding systems and/or devices.

Any reference numerals in the claims are intended to be non-limiting for their scope.

The invention claimed is:

1. A method for operating a hearing system comprising a hearing device, a first audio gateway device adapted to being worn by an individual and a second audio gateway device adapted to being mounted in a car, the method comprising:

in the hearing device, extracting audio signals from close-range electromagnetic signals and providing audible signals to the individual based on the extracted sound signals;

in the first audio gateway device, extracting a first audio signal from an electromagnetic signal received from a first remote device and transmitting a close-range electromagnetic signal comprising the first audio signal to the hearing device via a first antenna;

in the second audio gateway device, extracting a second audio signal from an electromagnetic or electric signal received from a second remote device and transmitting a close-range electromagnetic signal comprising the second audio signal to the hearing device via a second antenna;

detecting when the first audio gateway device is in a predefined location with respect to the second audio gateway device; selectively enabling an in-car mode in dependence on the first audio gateway device being in the predefined location; and disabling a function and/or a unit of the first audio gateway device in the in-car mode.

2. A method according to claim 1, wherein the close-range electromagnetic signals are near-field magnetic induction signals.

3. A method according to claim 1, wherein the close-range electromagnetic signals are low-power radio signals.

4. A method according to claim 1, wherein disabling a function and/or a unit of the first audio gateway device comprises disabling transmission of close-range electromagnetic signals by the first audio gateway device.

5. A method according to claim 1, wherein disabling a function and/or a unit of the first audio gateway device comprises disabling one or more user controls on the first audio gateway device.

6. A method according to claim 1 and further comprising: in the second audio gateway device, in the in-car mode, extracting a third audio signal from an electromagnetic signal received from the first remote device and transmitting a close-range electromagnetic signal comprising the third audio signal to the hearing device.

7. A method according to claim 1 and further comprising: automatically enabling the in-car mode when the first audio gateway device enters the predefined location and/or automatically disabling the in-car mode when the first audio gateway device leaves the predefined location.

8. A hearing system comprising a hearing device and a first audio gateway device adapted to being worn by an individual, the hearing device being adapted to extract audio signals from close-range electromagnetic signals and to provide audible signals to the individual based on the extracted sound signals, the first audio gateway device being adapted to extract a first audio signal from an electromagnetic signal received from a first remote device and to transmit a close-range electromagnetic signal comprising the first audio signal to the hearing device via a first antenna, wherein the hearing system further comprises a second audio gateway device adapted to being mounted in a car and means for detecting when the first audio gateway device is in a predefined location with respect to the second audio gateway device, the second audio gateway device being adapted to extract a second audio signal from an electromagnetic or electric signal received from a second remote device and to transmit a close-range electromagnetic signal comprising the second audio signal to the hearing device via a second antenna, and the hearing system being adapted to selectively enable an in-car mode in dependence on the first audio gateway device being in the predefined location and to disable a function and/or a unit of the first audio gateway device in the in-car mode.

9. A hearing system according to claim 8, wherein the close-range electromagnetic signals are near-field magnetic induction signals.

10. A hearing system according to claim 8, wherein the close-range electromagnetic signals are low-power radio signals.

11. A hearing system according to claim 8 and further being adapted to disable transmission of close-range electromagnetic signals by the first audio gateway device in the in-car mode.

12. A hearing system according to claim 8 and further being adapted to disable one or more user controls on the first audio gateway device in the in-car mode.

13. A hearing system according to claim 8, wherein the second audio gateway device (is further adapted to extract a third audio signal from an electromagnetic signal received from the first remote device and to transmit a close-range electromagnetic signal comprising the third audio signal to the hearing device when the hearing system is in the in-car mode.

14. A hearing system according to claim 8 and further being adapted to automatically enable the in-car mode when the first audio gateway device enters the predefined location and/or to automatically disable the in-car mode when the first audio gateway device leaves the predefined location.

15. A first audio gateway device adapted to being worn by an individual, the first audio gateway device further being adapted to extract an audio signal from an electromagnetic signal received from a remote device and to transmit a close-range electromagnetic signal comprising the audio signal to a hearing device via an antenna, wherein the first audio gateway device comprises means for detecting when the first audio gateway device is in a predefined location with respect to a second audio gateway device mounted in a car and in that the first audio gateway device is further adapted to selectively enable an in-car mode in dependence on the first audio gateway device being in the predefined location and to disable a function and/or a unit of the first audio gateway device in the in-car mode.

16. A first audio gateway device adapted to being mounted in a car, the first audio gateway device further being adapted to extract an audio signal from an electromagnetic or electric signal received from a remote device and to transmit a close-range electromagnetic signal comprising the audio signal to a hearing device via an antenna, wherein the first audio gateway device comprises means for detecting when a second audio gateway device is in a predefined location with respect to the first audio gateway device and in that the first audio gateway device is further adapted to selectively enable an in-car mode in dependence on the second audio gateway device being in the predefined location and to transmit control signals comprising an indication of mode changes to the second audio gateway device.

17. A method according to claim 2, wherein disabling a function and/or a unit of the first audio gateway device comprises disabling transmission of close-range electromagnetic signals by the first audio gateway device.

18. A method according to claim 3, wherein disabling a function and/or a unit of the first audio gateway device comprises disabling transmission of close-range electromagnetic signals by the first audio gateway device.

19. A method according to claim 2, wherein disabling a function and/or a unit of the first audio gateway device comprises disabling one or more user controls on the first audio gateway device.

20. A method according to claim 3, wherein disabling a function and/or a unit of the first audio gateway device comprises disabling one or more user controls on the first audio gateway device.

* * * * *